United States Patent [19]

Stenberg

[11] Patent Number: 4,539,074

[45] Date of Patent: Sep. 3, 1985

[54] METHOD AND APPARATUS FOR DETECTING AND COUNTERACTING A DEFORMATION OF THE STOCK DISCHARGE GAP IN A HEADBOX OF A PAPER MACHINE

[75] Inventor: Erik G. Stenberg, Gillbergsgatan, Sweden

[73] Assignee: KMW Aktiebolag, Karlstad, Sweden

[21] Appl. No.: 610,330

[22] Filed: May 15, 1984

[30] Foreign Application Priority Data

May 27, 1983 [SE] Sweden ..... 8302987

[51] Int. Cl.[3] ..... D21F 11/00

[52] U.S. Cl. ..... 162/198; 162/259; 162/252; 162/344; 162/347; 162/DIG. 11

[58] Field of Search ..... 162/344, 345, 346, 347, 162/DIG. 11, 252, 259, 198

[56] References Cited

U.S. PATENT DOCUMENTS 3,468,756 9/1969 Villa ..... 162/344
3,994,773 11/1976 Wolf et al. ..... 162/347
4,162,189 7/1979 Kirjavainen ..... 162/344
4,342,619 8/1982 Gladh ..... 162/347
4,455,197 6/1984 Croteau et al. ..... 162/344

*Primary Examiner*—William Smith
*Assistant Examiner*—Andrew J. Anderson
*Attorney, Agent, or Firm*—Bell, Seltzer, Park & Gibson

[57] ABSTRACT

The invention relates to a method and an apparatus for detecting and counteracting a deformation of the stock discharge gap in a paper machine headbox, which is caused by thermal expansion due to the temperature of the stock and/or the pressure of the stock. This is achieved by ultrasonic transducers located close to the slice opening which obtain measurement results relating to the distance between the roof member and the apron beam member of the headbox. At least two such transducers, one preferably located close to a side wall of the discharge gap and the other preferably located midway between the side walls, give information about a possible difference between the measurement results caused by the deformation. This difference serves as a guide for adjusting the temperature of the apron beam member and/or the roof member in such a way that the deformation is reduced in magnitude or entirely eliminated.

13 Claims, 4 Drawing Figures

METHOD AND APPARATUS FOR DETECTING AND COUNTERACTING A DEFORMATION OF THE STOCK DISCHARGE GAP IN A HEADBOX OF A PAPER MACHINE

FIELD AND BACKGROUND OF THE INVENTION

The present invention relates to a method and an apparatus for detecting and counteracting a deformation of the stock discharge gap in a headbox of a paper machine during its operation. The headbox includes a roof member and an apron beam member which cooperate to define the stock discharge gap therebetween.

Headboxes are included in the wet end of a paper machine and are used to distribute the stock uniformly over the width of the wire and for controlling the rate of discharge so that the stock is deposited onto the wire at equal velocities and in the same direction along the whole width of the wire. Demands for higher manufacturing velocities in paper machines cause increased problems with producing a paper web of satisfactory quality in respect of, inter alia, a uniform basis weight. Therefore, it is of great importance to keep the shape of the slice opening constant and under careful control so that the discharged stock Jet will be uniform with respect to velocity and thickness and so that as a consequence thereof optimum dry weight and moisture profiles of the paper web are obtained.

A number of parameters may influence the shape of the discharge gap. For example, the pressure of the stock in the headbox can cause a deflection in the central portion of the lips and result in an increased basis weight in this area. In accordance with U.S. Pat. No. 3,468,756 (Villa), such a deflection is counteracted by heating the support beam directly beneath the lower lip and/or by cooling the lower portion of the frame included in the apron beam in such a manner that the deflection of the lower lip is counteracted. This correction is based on a theoretical calculation of the deflection, and the patent fails to provide any apparatus or method by which the actual deflection of the lip may be determined while the machine is in operation. U.S. Pat. No. 3,994,773 (Wolf et al.) discloses an apparatus for indirectly detecting the deflection of the upper lip of a headbox by measuring a displacement between measuring elements mounted on top of the lip. The measuring method disclosed in this patent provides an approximate result as to the deflection, which is then counteracted by adjusting spindles supporting the upper side of the lip. Similarly, U.S. Pat. No. 4,342,619 (Gladh) discloses an apparatus for detecting the deflection of a profile bar mounted on the upper slice lip. However, neither Wolf et al. nor Gladh provides an apparatus for detecting or correcting relative displacements between both lips.

An obJect of the present invention is to provide more accurate detection and counteraction of a deformation in the shape of the stock discharge gap than that which has been achievable previously.

SUMMARY OF THE INVENTION

In accordance with the present invention, ultrasonic transducer means are employed for directly measuring the size of the stock discharge gap. At least two such transducer means are used, one preferably located close to one end of the discharge gap, another preferably located toward the middle of the gap opening. From the transducer means, a difference between the measurement results at the two locations is obtained, which represents an actual deflection of the apron and roof members which define the stock discharge gap. This difference will give guidance as to a heating or a cooling of the roof member or the apron beam member or both in such a manner that the deformation is counteracted.

Thus, in one aspect, the present invention provides a method for detecting and counteracting deformation of a stock discharge gap defined between an apron beam member and a cooperating roof member in the headbox of a paper machine comprising:

(a) ultrasonically measuring the stock discharge gap between the apron beam member and the roof member at at least two locations along the length of the stock discharge gap;

(b) obtaining the difference between the measurement results for at least two locations along the length of the stock discharge gap; and (c) adjusting the temperature of at least one of said apron beam member and roof member in response to the obtained difference in measurement results so as to reduce the magnitude of any deformation in the stock discharge gap.

The present invention also provides an apparatus for detecting and counteracting deformation of a stock discharge gap in the headbox of a paper machine comprising:

(a) stock delivery means including an apron beam member and a roof member, positioned in spaced apart relation and cooperating to define a stock discharge gap therebetween;

(b) at least two ultrasonic transducer means mounted in said members at different locations along the length of the stock discharge gap, each being positioned for transmitting ultrasonic pulses to the oppositely positioned member and to thereby measure the stock discharge gap at such location;

(c) control means connected to each of said transducer means and operable for obtaining the difference between the measurement results for at least two locations along the length of the stock discharge gap; and (d) temperature adjusting means operatively connected to said control means and responsive to the obtained difference in measurement results for adJusting the temperature of at least one of said apron beam member and roof member so as to reduce the magnitude of any deformation in the stock discharge gap.

In comparison with previously available methods, a method and an apparatus according to the present invention have considerable advantages. By directly measuring the size of the stock discharge gap, a more exact measurement result is obtained than if the measurement is carried out indirectly on elements above or below the gap, since such indirect measurements can never describe the same mutual movement, i.e., displacement, as that of the lips. An additional advantage of the invention is realized in that the obtained difference in measurement results can be utilized to directly control the nature and the magnitude of the step that is taken in order to counteract the deformation of the discharge gap. Still another obtained advantage is that the application of the invention operates independently of the specific size setting of the slice opening at any given time.

BRIEF DESCRIPTION OF THE DRAWINGS

Some of the features and advantages of the invention having been stated, others will become apparent from the detailed description which follows with appropriate reference to the accompanying drawings in which.

DETAILED DESCRIPTION OF THE ILLUSTRATED EMBODIMENTS

Figure 1:
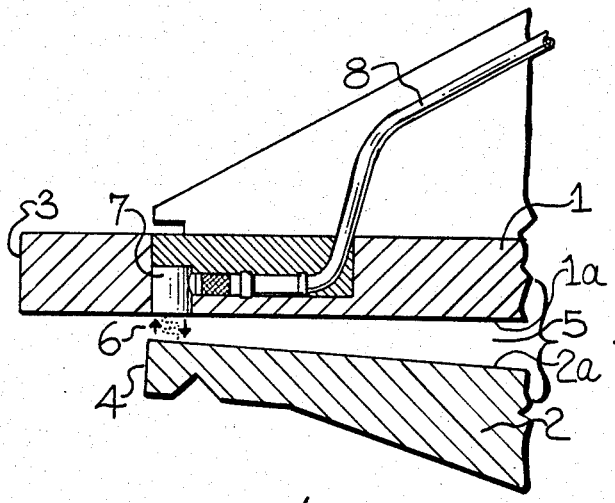
FIG. 1 is a partial cross-sectional view of a headbox showing the lip portions of the apron beam member and roof member according to one embodiment of the invention.
Figure 2:
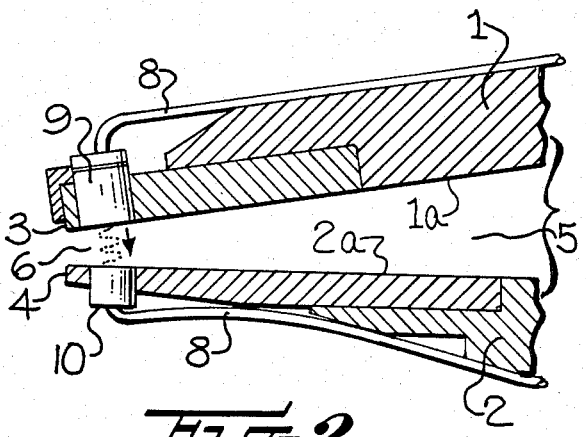
FIG. 2 is a partial cross-sectional view similar to FIG. 1 showing the lip portions of the apron beam member and roof member according to a second embodiment of the invention.

FIGS. 1 and 2 show schematically the nozzle of a headbox for the production of a single layer fiber web. The headbox comprises two opposed, substantially horizontal walls formed by a bottom wall 1*a* of a roof member 1 and a top wall 2*a* of an apron beam member 2. The roof member 1 and apron beam member 2 include portions which form an upper lip 3 and a lower lip 4, respectively. The roof member bottom wall 1*a* and apron beam member top wall 2*a* define therebetween a space 5 that converges in the direction of the flow, and ends at the lips in a stock discharge gap 6 in the form of a slice opening. The roof member 1 or its upper lip 3 is adjustable for setting the size of the slice opening 6. At the upper lip 3 close to the stock discharge gap 6 there is mounted an ultrasonic transducer means 7, which is arranged to give a measurement result corresponding to the distance from the lower lip 4. The ultrasonic transducer means suitably is of the kind comprising a piezoelectric crystal and operates both as a transmitter and a receiver for ultrasound. The ultrasonic wave is reflected against the opposed lip and is detected on return to the transducer. As a result, the travel time of the ultrasonic wave is a measure of the two-way distance between the surfaces, and with knowledge of the sound velocity in the medium, which knowledge is obtainable by means of a reference measurement, for example, the real distance between the lips can be calculated, if desired. In order to transform a signal of an ultrasonic transducer into an absolute distance, it is necessary to know the velocity of the ultrasonic wave in the medium, i.e., the stock. The temperature of the stock varies and consequently also the sound velocity in the stock. For this purpose, a reference measurement under the same conditions is required and can be arranged. Such a measurement is the subject of another pending patent application, U.S. Ser. No. 426,104, filed Sept. 28, 1982 assigned to the same assignee as the present application. However, in accordance with the present invention, knowledge of the absolute distance between the lip members is not required. Instead, the difference between two measurement results obtained at two separate locations along the discharge gap is measured. As a result, one measurement will constitute a reference for the other one, but the errors, which usually may arise when measuring on a separate reference element, will be eliminated by this method of determining the difference. The ultrasonic transducer is connected by means of a coaxial cable 8 to a control means such as a conventional electronic measuring unit designed for use with ultrasonic transducers.

Rather than being mounted in the roof member 1 as shown in FIG. 1, the ultrasonic transducer may be alternatively mounted in the apron beam member 2 if this design is more suitable. As shown in FIG. 2, in accordance with another embodiment of the invention, the ultrasonic transducer may be provided with separate transmitter and receiver functions. As shown in FIG. 2, a transmitter crystal 9 is mounted in the roof member 1 and a receiver crystal 10 is placed just opposite the transmitter 9 in the apron beam member 2. The ultrasonic wave then will pass a one-way distance and directly indicate a measurement result corresponding to the distance between the lips.

The invention may also be applied to a multi-layer stock headbox where one or more partitions in the converging space separate two or more stocks from each other before they reach the forming fabric of the machine. These partitions may block a measurement of the distance between the lips, but this problem is solved by providing the partitions with holes in the direction of travel of the ultrasonic wave.

Figure 3:
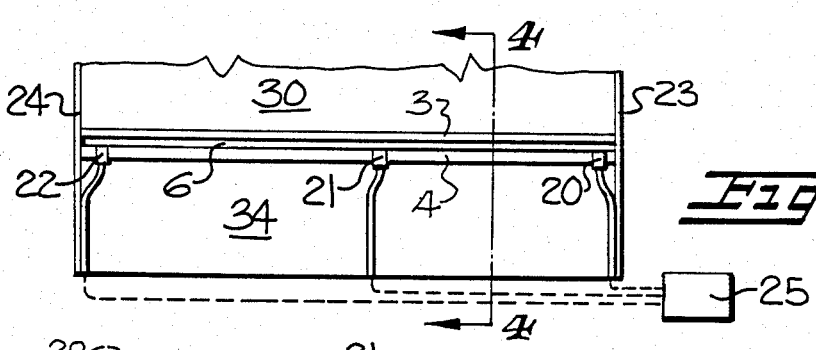
FIG. 3 shows a partial front elevational view of a headbox with ultrasonic measuring devices mounted therein according to an embodiment of the invention.

The number of ultrasonic transducers required must be at least two according to the invention in order to measure a difference corresponding to any existing deformation, and they also have to be placed at different locations along the length of the stock discharge gap. As shown in FIG. 3, the stock discharge gap 6 is defined by the upper lip portion 3 of the roof member, the lower lip portion 4 of the apron beam member and opposing side walls 23 and 24. Ultrasonic transducers 20, 21 and 22 are connected through suitable cables to a control means in the form of an electronic measuring unit 25. If, as shown in FIG. 3, one transducer 20 is located close to the one side wall 23 of the discharge gap and another transducer 21 is located at approximately the middle of the discharge gap, a measurement result is obtained that should correspond to a maximum instantaneous deformation if it is assumed that a symmetric design also gives a symmetric deformation. If the user wants to take into consideration the possibility of the discharge gap not being perfectly rectangular, a third transducer 22 may be located close to the other side wall 24 at the same distance from that wall as the first transducer 20 is placed from its side wall 23 of the discharge gap. Then the measuring unit 25 may first determine the mean value of the measurement results from the transducers 20, 22 at the side walls and then obtain the difference between the mean value and the measurement result obtained by the transducer 21 in the middle. It is possible to take a further step to ensure accuracy in determining the extent of the deformation, which is of interest if it is possible that the deformation will not be symmetric in relation to the vertical symmetry axis of the discharge gap. A plurality of transducers are then inserted between the two outermost transducers, and the measuring unit is designed to determine the difference in turn between the measurement results of every one of these transducers and the mean value for the measurements obtained at the two outer transducers.

Preferably the transducers should also be placed at equal distances from the stock discharge gap, but if that is impossible, a correction for the convergence of the slice chamber may be included, e.g., in the program of the measuring unit 25 or in the program of a process computer or in any other suitable way for determining the magnitude of the difference.

During operation of the headbox, the stock discharge gap may be deformed in such a way that the gap is larger in the middle of the opening than at the ends. This will result in a paper web having a higher basis weight in its center than at its edges. The reason for such a deformation may be that a high pressure in the stock has a distending effect on the lips. The measured difference may in such a case be called positive, for example, as the measurement result measured by the central transducer is reduced by the measurement result obtained by the transducer at the side wall. If, however, the pressure of the stock is not of such a magnitude that a bulging in the middle of the gap is obtained, the case may instead be that the high temperature of the stock, often 50°–60° C., first heats the inwardly facing portion of the lips, which then distend in relation to the opposite sides of the lips or in relation to a framework supporting the roof member or the apron beam member, and such a development may lead the lips to bulge towards each other. In this case a negative difference will be obtained when making the above calculations. The electronic measuring unit 25 can be designed to distinguish the type of difference (whether positive or negative) and to transmit different signals therefor to effect different corrective steps for reducing the deformation.

The electronic processing of the measurement results and the continued treatment thereof may be carried out in a number of ways in accordance with known techniques. The outputs of the measuring unit 25 can provide control signals that grade the magnitudes of the measured differences and that also distinguish between a positive and a negative difference. These outputs are connected to temperature adjusting means, which in turn carry out the corrective steps needed for counteracting the deformation.

In the event that a positive difference is measured, i.e., when the lip members bulge outwards so that the gap becomes larger at the center of the slice opening than at the ends thereof, it is suitable to carry out a cooling of the lip members or of the apron beam member or the roof member closest to the stock. In this way, the temperature raising effect of the stock is counteracted. In case a negative difference is measured, the deformation may be reduced or counteracted by heating the portions of the apron beam member or the roof member that are situated farther away from the slice opening. The media for the cooling or the heating are suitably conducted through conduits in or externally of the lip portions, the apron beam member, or the roof member. In some cases a combination including heating of a portion of the roof member or the apron beam member as well as cooling of another portion may be the most suitable step.

Figure 4:
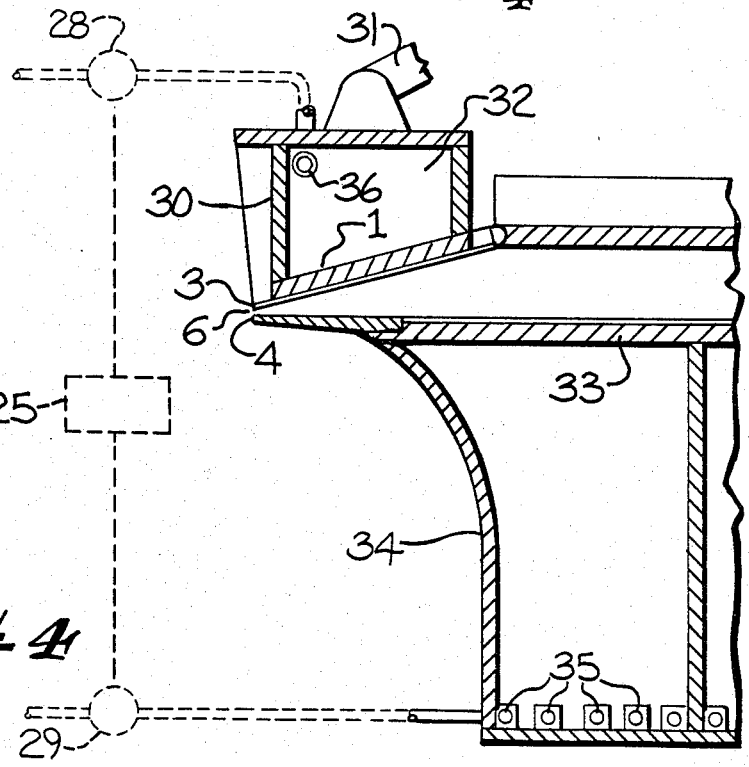
FIG. 4 is a more complete side cross-sectional view of the headbox of FIG. 3, taken substantially along the line 4—4 in FIG. 3, and showing the supporting frame included in the apron beam and roof members in the headbox.

FIG. 4 further illustrates how deformation counteracting steps may be applied in a headbox. As illustrated, the roof member 1 includes a supporting frame generally indicated at 30, to which a force transmitting device 31 is connected for setting the size of the slice opening 6. The frame 30 forms a closed space 32 along the entire width of the upper lip. In this embodiment of the invention a port 36 communicates with this space 32 for circulating a heating or cooling medium through the space. If the temperature of a heating medium is kept at the same level as the temperature of the stock, a deformation of the upper lip portion of the roof member 1 caused by the stock temperature is reduced or eliminated. The temperature of the heating medium may be controlled automatically by means of cartridge type heaters, for example. In this embodiment, the lower lip 4 extends from an apron plate 33 which, together with a supporting frame 34, comprise the apron beam member. At the bottom of this frame there are located tubes 35, in this case for a heating medium. Alternatively, it is possible, if desired, to dispense with the tubes 35 and instead use the entire space defined by the frame 34 where the tubes are located as a flow conduit similar to the conduit 32 in the roof member. The heating medium is to produce an elongation of the lower portion of the frame to the same magnitude as the elongation of the apron plate 33 and the lower lip 4. Circulation of the fluid is controlled by actuation of valves 28, 29 which are responsive to the measuring unit 25.

A gas or a liquid can be used as the cooling medium. Refrigerants may be used, but air or cold water may be the simplest fluids to employ, the latter being the most efficient one of the two. As a heating medium, hot water or steam may be the most suitable media, but other gases or liquids may be suitably employed. Also the use of so-called Peltier elements is possible as is heating by means of electric resistance elements.

The control signal or pulse from the electronic measuring unit 25 may in a known manner be utilized to invoke the heating or cooling steps required for counteracting the deformation, for example, by opening valves 28, 29 for circulating a heating or a cooling fluid, respectively. If the heating or the cooling is to be proportional against the magnitude of the deformation, i.e., the magnitude of the difference, this can be arranged, e.g., by a step-wise or a continuous control of a feed pump for the cooling or the heating medium, if it is a liquid, or by a controlling fan or a compressor, if the medium is a gas, or by controlling flow restrictions, such as throttle valves or in some other known way.

The invention is not limited to the preferred embodiment described above and illustrated in the drawings, but can be varied within the scope of the claims.

That which is claimed is:

1. A method for detecting and counteracting deformation of a stock discharge gap defined between an apron beam member and a cooperating roof member in the headbox of a paper machine comprising:

(a) ultrasonically measuring the stock discharge gap between the apron beam member and the roof member at at least two locations along the length of the stock discharge gap;

(b) obtaining the difference between the measurement results for at least two locations along the length of the stock discharge gap; and (c) adjusting the temperature of at least one of said apron beam member and roof member in response to the obtained difference in measurement results so as to reduce the magnitude of any deformation in the stock discharge gap.

2. A method according to claim 1 wherein the step of ultrasonically measuring comprises ultrasonically measuring the gap at a first location medially of the length of the stock discharge gap and at a second location adjacent one end of the stock discharge gap.

3. A method according to claim 2 further comprising measuring the gap at a third location adjacent the opposite end of the discharge gap from said second location and obtaining a mean value from the measurement results at said second and third locations, and wherein said step of obtaining the difference between the measurement results comprises obtaining the difference between said mean value and the measurement results at said first location.

4. A method according to claim 1 wherein the step of adjusting the temperature comprises circulating a heat transfer fluid in heat transferring relation to at least one of said apron beam member or roof member.

5. A method according to claim 1 wherein the step of obtaining the difference further comprises producing a control signal which is functionally related to the difference between the measurement results and wherein the step of adjusting the temperature is in response to the said control signal.

6. A method for detecting and counteracting deformation of a stock discharge gap in the headbox of a paper machine defined between an apron beam member having an underlying supporting frame and a cooperating roof member having an overlying supporting frame comprising:

(a) ultrasonically measuring the stock discharge gap between the apron beam member and the roof member at at least two locations along the length of the stock discharge gap;

(b) obtaining the difference between the measurement results for at least two locations along the length of the stock discharge gap; and (c) adjusting the temperature of at least one of said supporting frames in response to the obtained difference in measurement results so as to reduce the magnitude of any deformation in the stock discharge gap.

7. An apparatus for detecting and counteracting deformation of a stock discharge gap in the headbox of a paper machine comprising:

(a) stock delivery means including an apron beam member and a roof member positioned in spaced-apart relation and cooperating to define a stock discharge gap therebetween;

(b) at least two ultrasonic transducer means mounted in said members at different locations along the length of the stock discharge gap, each being positioned for transmitting ultrasonic pulses to the oppositely positioned member and to thereby measure the stock discharge gap at such location;

(c) control means connected to each of said transducer means and operable for obtaining the difference between the measurement results for at least two locations along the length of the stock discharge gap; and (d) temperature adjusting means operatively connected to said control means and responsive to the obtained difference in measurement results for adjusting the temperature of at least one of said apron beam member and roof member so as to reduce the magnitude of any deformation in the stock discharge gap.

8. An apparatus according to claim 7 wherein said ultrasonic transducer means are mounted at a first location medially of the length of the stock discharge gap and at a second location adjacent one end of the stock discharge gap.

9. An apparatus according to claim 8 further comprising ultrasonic transducer means mounted at a third location adjacent the opposite end of the discharge gap from said second transducer means and wherein said control means is operable for obtaining a mean value from the measurement results at said second and third locations, and for obtaining the difference between said mean value and the measurement results at said first location.

10. An apparatus according to claim 7 wherein said temperature adjusting means comprises means for circulating a heat transfer fluid in heat transferring relation to said apron beam member and to said roof member.

11. An apparatus according to claim 7 wherein said control means includes means operable for producing a control signal which is functionally related to the difference between the measurement results and wherein said temperature adjusting means is responsive to said control signal.

12. An apparatus for detecting and counteracting deformation of a stock discharge gap in the headbox of a paper machine comprising:

(a) stock delivery means including an apron beam member and a roof member positioned in spaced-apart relation and cooperating to define a stock discharge gap therebetween, the apron beam member having an underlying supporting frame and the roof member having an overlying supporting frame;

(b) at least two ultrasonic transducer means mounted in said members at different locations along the length of the stock discharge gap, each being positioned for transmitting ultrasonic pulses to the oppositely positioned member and to thereby measure the stock discharge gap at such location;

(c) control means connected to each of said transducer means and operable for obtaining the difference between the measurement results for at least two locations along the length of the stock discharge gap; and (d) temperature adjusting means operatively connected to said control means and responsive to the obtained difference in measurement results for adjusting the temperature of at least one of said supporting frames so as to reduce the magnitude of any deformation in the stock discharge gap.

13. An apparatus according to claim 12 wherein at least one of said supporting frames includes means defining a fluid passageway therethrough, and said temperature adjusting means comprises means for circulating a heat transfer fluid through said fluid passageway.

* * * * *